US005614133A

United States Patent [19]

Tanaka et al.

[11] Patent Number: 5,614,133

[45] Date of Patent: Mar. 25, 1997

[54] METHOD FOR PRODUCING THIN-FILM ELECTRO LUMINESCENT DEVICE

[75] Inventors: Koichi Tanaka, Nara; Masaru Yoshida, Ikoma-gun, both of Japan

[73] Assignee: Sharp Kabushiki Kaisha, Osaka, Japan

[21] Appl. No.: 415,473

[22] Filed: Mar. 31, 1995

[30] Foreign Application Priority Data

May 27, 1994 [JP] Japan ..... 6-115657

[51] Int. Cl.[6] ..... G09K 11/00

[52] U.S. Cl. ..... 264/21; 264/430; 264/482; 264/492

[58] Field of Search ..... 264/21, 430, 482, 264/492

[56] References Cited

FOREIGN PATENT DOCUMENTS

| | | |
|---|---|---|
| 52-10358 | 3/1977 | Japan . |
| 2275622 | 11/1990 | Japan . |
| 3141584 | 6/1991 | Japan . |
| 5159878 | 6/1993 | Japan . |
| 5251182 | 9/1993 | Japan . |

*Primary Examiner*—Christopher A. Fiorilla

[57] ABSTRACT

The present invention is directed to a method and an apparatus for producing thin-film EL devices with short annealing treatment times and excellent productivity.

A substrate to be subjected to annealing treatment is mounted on the surface of a stage. The substrate to be treated is constructed by forming lower electrodes, a lower insulating layer, an EL layer and an upper insulating layer in that order on a translucent substrate. Light-irradiating means is provided above and opposite the surface of the stage. The light-irradiating means includes a plurality of light sources and a reflecting panel, and the light sources are situated along each of a plurality of concavities provided in the reflecting panel. Light from the light sources irradiates roughly the entire surface of the substrate to be treated. The light from the light sources is selected so as to include the absorption wavelength band of the electrode material of the lower electrodes on the substrate. When a prescribed temperature is reached, the light irradiation is terminated to allow cooling.

7 Claims, 16 Drawing Sheets

METHOD FOR PRODUCING THIN-FILM ELECTRO LUMINESCENT DEVICE

BACKGROUND OF THE INVENTION

1. Field of the Invention

The present invention relates to methods for producing thin-film EL devices that utilize the phenomenon of electroluminescence resulting from the application of an alternating electric field, and particularly it relates to methods of annealing treatment to improve the luminescence of thin-film EL devices, and to apparatuses for producing thin-film EL devices by the above-mentioned annealing treatment.

2. Description of the Related Art

Thin-film EL (electroluminescent) devices may be employed as all solid-state flat panel-type display devices, and because they offer more excellent characteristics than liquid crystal display, such as high contrast and visibility, much research and development is being carried out with the aim of making them practically useful. Research and development is being carried out, for example, for their use in providing color displays. Also, thin-film EL devices capable of providing orange-and-black displays are being satisfactorily used as the display means in FA (factory automation) and OA (office automation) systems.

Double-insulated thin-film EL devices constitute an example of thin-film EL devices whose research and development are presently being promoted for the purpose of practical use. These devices are constructed by laminating on one surface of a translucent substrate realized by, for example, glass, a lower electrode realized by a transparent electrode such as ITO (indium tin oxide), a lower insulating layer, an EL layer, an upper insulating layer and an upper electrode realized by Al (aluminum) or the like, in that order.

The EL layer comprises a host material and luminescence centers incorporated into the host material. When an electric field is generated by applying an alternating voltage between the lower and upper electrodes, the free electrons in the EL layer that have been acknowledged by the electric field collide with the luminescence centers, thus exciting them. The excited luminescence centers then produce the phenomenon of electroluminescence when they return to a stable energy level (ground state). Consequently, it is possible to obtain a display image by combining states of luminescence and non-luminescence through control of the alternating voltage applied to the electrodes.

FIG. 20 is a schematic cross-sectional view of the construction of an annealing apparatus 1 used to produce a conventional thin-film EL device. The EL layer of the thin-film EL device is usually prepared by electron beam deposition, sputtering, CVD (chemical vapor deposition), or the like. Because the EL layer is formed on a lower insulating layer made of a different material from an EL layer material, the crystallinity of the host material is impaired, non-emissive centers are formed in the host material, and the crystal field of the host material is disturbed. In addition, the distribution of luminescence centers in the host material is not uniform, but rather there exist regions of high and low density of luminescence centers, and those regions of high density cause disturbance of the crystal field of the host material. As a result, the flow of electrons which are to excite the luminescence centers is impeded in the regions of high density of luminescence centers, while in the regions of low density of luminescence centers the electrons meet the luminescence centers with less frequency; therefore the excitation efficiency is lowered and the luminance is reduced. The luminance is particularly reduced in the regions of high density of luminescence centers.

In order to prevent this reduction in the luminance, annealing treatment is performed on the EL layer prepared by one of the methods mentioned above, i.e. electron beam deposition, sputtering or CVD. The conventional annealing apparatus 1 shown in the figure has a construction which includes a stage 3 which holds a plurality of thin-film EL devices 2 which are to be treated, a base 4 on which the stage 3 is anchored, a housing 6 on the surface of the base 4 on which the stage 3 is anchored, to create a space 5 within which are situated the stage 3 and the plurality of thin-film EL devices 2 held by the stage 3, a heater 7 for heating the space 5, and a pump 8 for depressurization of the space 5.

FIG. 21 is a flow diagram showing the steps of conventional annealing treatment using the above-mentioned annealing apparatus 1. In step cl, the plurality of thin-film EL devices 2 are placed in the stage 3 anchored to the base 4, and the housing 6 is mounted over the base 4. In step c2, the space 5 in which the stage 3 and the plurality of thin-film EL devices 2 are situated is depressurized by the pump 8 which is, for example, an oil diffusion pump or oil rotary pump. The depressurization is carried out to a degree of vacuum of, for example, $10^{-4}$ Pa or lower.

In step c3, the space 5 is heated by the heater 7. The heating is carried out, for example, at a heat-elevating rate of from 10° to 20° C. per minute to 600° C. This causes heating of the plurality of thin-film EL devices 2 situated in the space 5. In step c4, the space 5 is kept at a prescribed temperature for, as an example, 1 to 2 hours. Intermittent heating of the space 5 by the heater 7 keeps the plurality of thin-film EL devices 2 at the prescribed temperature. In step c5, the space 5 is cooled. It is cooled, for example, naturally by allowing to stand after termination of the heating by the heater 7. The plurality of thin-film EL devices 2 are cooled in this manner.

This annealing treatment rearranges the molecules of the host material and thus improves its crystallinity. In addition, the luminescence centers are diffused in the host material to improve the uniformity of their distribution therein. Since the crystallinity of the host material is improved, there are fewer non-emissive centers and there is less disturbance of the crystal field of the host material. This gives greater freedom of flow to the free electrons which are to excite the luminescence centers. In addition, the greater uniformity of distribution of the luminescence centers reduces the number of regions of high density of luminescence centers which disturb the crystal field of the host material. This increases the frequency with which the free electrons meet the luminescence centers. Consequently, the excitation efficiency of the luminescence centers improves and the luminance increases. Annealing treatment by which this effect is achieved is indispensable during the production process for thin-film EL devices in order to obtain excellent luminescent properties. Furthermore, a higher luminance is generally obtained with treatment at higher temperatures.

The annealing treatment described above is disclosed in, for example, Japanese Patent Application Publication SHO 52-10358. Furthermore, Japanese Patent Application Disclosure HEI 3-141584 discloses an example of forming an Si layer on a lower insulating layer and forming an EL layer over the Si layer. Improvement in the crystallinity of this Si layer is attempted by annealing treatment after depositing the St. The EL layer formed over the highly crystalline Si layer has excellent crystallinity. Laser light or an electron beam is used for this annealing treatment.

Furthermore, in Japanese Patent Application Disclosure HEI 5-159878 there is disclosed an example of annealing treatment which involves heating first by irradiation with light which includes rays in the absorption wavelength band of the luminescence centers, and then by irradiation with light which includes rays in the absorption wavelength band of the host material. The irradiating light used is laser light, and the wavelength band is selected within a range of 100 to 750 nm. Moreover, Japanese Patent Application Disclosure HEI 5-251182 discloses an example of annealing treatment in an inert gas atmosphere.

The disclosed examples mentioned above relate to annealing treatment of thin-film EL devices, but other examples of annealing treatment of silicon thin-films formed on glass substrates have been disclosed, particularly in Japanese Patent Application Disclosure HEI 2-275622. According to this document, heating silicon thin-films by irradiation with light lacking the absorption wavelength component of their glass substrates makes it possible to perform annealing treatment on silicon thin-films in a short time without heat deformation of the glass substrates.

In the case of the examples in Japanese Patent Application Publication SHO 52-10358 and Japanese Patent Application Disclosure HEI 5-251182 mentioned above, time is required for depressurization, heating, maintenance of heating and cooling, and the time for each of these is long. Thus, the long annealing treatment time lowers the productivity of the thin-film EL devices.

Also, in the case of Japanese Patent Application Disclosure HEI 3-141584, since a Si layer is formed by depositing of Si followed by annealing treatment of the Si prior to formation of the EL layer, the step of formation of the Si layer is necessary. Furthermore, because the method uses laser light or an electron beam, which have minute irradiating areas, EL layers with large areas require long times for annealing treatment, and thus the productivity of the thin-film EL devices is lowered.

Furthermore, in the case of Japanese Patent Application Disclosure HEI 5-159878, a two-stage annealing treatment is necessary and laser light is used, and thus the productivity of the thin-film EL devices is lowered for the same reasons mentioned above.

Moreover, the case of Japanese Patent Application Disclosure HEI 2-275622 involves annealing treatment of silicon thin-films formed on glass substrates, not of thin-film EL devices, and therefore the crystallinity of EL layers is not necessarily improved by the annealing treatment disclosed in this document. In addition, EL layers of thin-film EL devices are formed on translucent substrates realized by, for example, glass, and therefore the annealing treatment is performed on the translucent substrates as well. Consequently, there is risk of deformation of the translucent substrates when they are kept at high temperatures for prolonged periods.

SUMMARY OF THE INVENTION

It is an object of the present invention to provide a method and an apparatus for producing thin-film EL devices with short annealing treatment times and excellent productivity.

The invention relates to a method for producing a thin-film EL device comprising at least one EL layer and electrodes for applying an electric field to the EL layer, which method is characterized by performing annealing treatment, whereby the EL layer which comprises a host material and luminescence centers incorporated into the host material is heated to improve the crystallinity of the host material while rendering uniform the distribution of the luminescence centers in the host material, by irradiation of light which includes rays in the absorption wavelength band of the electrode material used to construct the electrodes.

The invention is further characterized in that indium tin oxide is selected as the electrode material, and light with a peak wavelength in the wavelength band of from 1.1 to 1.5 μm is selected as the light.

The invention is still further characterized in that the temperature-elevating rate at the time of annealing treatment is selected within a range of 200° C. to 600° C. per minute.

The invention is still further characterized in that the temperature-elevating rate at the time of annealing treatment is selected within a range of 400° to 500° C. per minute.

The invention is still further characterized in that the light irradiation is terminated immediately after the EL layer reaches a prescribed temperature.

The invention is still further characterized in that the light is irradiated in an inert gas atmosphere.

The invention further relates to an apparatus for producing thin-film EL devices which is characterized by including holding means for holding the substrate to be treated on which is formed at least one EL layer and electrodes for applying an electric field to the EL layer, by mounting it on a prescribed holding surface, and light-irradiating means for irradiating light which includes rays in the absorption wavelength band of the electrode material of which the electrodes are made, toward the substrate to be treated which is mounted at the holding surface.

The invention is further characterized in that the light irradiation area of the light-irradiating means is selected so as to be roughly equal to the size of the surface of the substrate to be treated which is mounted at the holding surface.

The invention is still further characterized in that the light irradiation area of the light-irradiating means is selected so as to be larger than the size of the surface of the substrate to be treated which is mounted at the holding surface.

The invention is still further characterized in that the light irradiation area of the light-irradiating means is selected so as to be smaller than the size of the surface of the substrate to be treated which is mounted at the holding surface, and at least either the holding means or the light-irradiating means is moved to irradiate light from the light-irradiating means onto the entire surface of the substrate to be treated.

According to the present invention, a thin-film EL device includes at least one EL layer and electrodes for applying an electric field to the EL layer, and the EL layer in turn comprises a host material and luminescence centers incorporated into the host material. This type of thin-film EL device is subjected to annealing treatment by heating the EL layer both to improve the crystallinity of the host material and to render uniform the distribution of the luminescence centers in the host material. According to the invention, this annealing treatment is performed by irradiation with light which includes rays in the absorption wavelength band of the electrode material used to construct the electrodes. The irradiated light is absorbed by the electrodes and is stored as heat energy. Because heat is stored in the electrodes thus reducing heat radiation from the EL layer, the EL layer is more efficiently heated. Consequently, the time required for annealing treatment may be shortened. Furthermore, when light is irradiated so that the space which contains the substrate to be annealed reaches the same setting temperature as according to the prior art, the EL layer results in having a higher temperature than with the prior art, and therefore it is possible to obtain a device with a high luminance. Moreover, a thin-film EL device with a high luminance may be obtained even when annealing treatment is performed under the critical temperature at which deformities occur in the translucent or other type of substrate on which the EL layer and electrodes are formed.

Furthermore, according to the invention indium tin oxide is selected as the electrode material, and light with a peak wavelength in the wavelength band of from 1.1 to 1.5 μm is selected as the light. This has been found to provide the effect similar to that described above.

Furthermore, according to the invention the temperature-elevating rate at the time of annealing treatment is selected within a range of 200° to 600° C. per minute. An improvement in the luminance of 10% or more has been observed with a temperature-elevating rate of 200° C./min or higher. Also, temperature control is relatively easy with a temperature-elevating rate of 600° C./min or lower.

The temperature-elevating rate is more preferably selected within a range of 400° to 500° C. per minute. At 400° C./min or higher, the luminance is further improved and the annealing treatment time is further shortened, thus improving the productivity of the thin-film EL devices. Also, temperature control is even easier at 500° C./min or lower.

Furthermore, according to the invention the light irradiation is terminated immediately after the EL layer reaches a prescribed temperature. This has also been found to provide the effect described above. Thus, there is no need to keep the device at a prescribed temperature for a certain time as according to the prior art, and thus productivity is further improved.

Furthermore, according to the invention the light is irradiated in an inert gas atmosphere. More preferably, one of $N_2$, Ar or He, or a mixture of at least two thereof, is selected as the inert gas. Performing the annealing treatment in an inert gas atmosphere eliminates the effect of oxygen on the EL layer when it is heated to a relatively high temperature, and also helps eliminate irregularities in the luminescence. Performing the annealing treatment in an inert gas atmosphere as according to the invention makes costly vacuum units unnecessary and thus renders annealing treatment more economical than with the prior art.

Furthermore, according to the invention the apparatus for producing thin-film EL devices is provided with holding means for holding the substrate which is to be treated by annealing and light-irradiating means for irradiating light toward the substrate to be treated which is held by the holding means. The substrate to be treated is a substrate on which is formed at least one EL layer and electrodes for applying an electric field to the EL layer. The light-irradiating means includes, for example, a plurality of equally spaced light sources positioned in an the area of a plane parallel to the holding surface and opposite roughly the entire surface of the substrate to be treated which is held by the holding means and a reflecting panel for reflecting light from the light source onto the holding surface of the holding means; the EL layer is heated by irradiation of light from this light source. Annealing treatment of EL layers using this type of apparatus may be performed uniformly and in bulk even on large-area EL layers.

The area of light irradiation by the light-irradiating means is intended to mean the effective area of light irradiation which is within the total area of light irradiation at a prescribed distance from the light source and at or greater than a prescribed strength of light intensity, and this effective area of light irradiation is selected so as to be roughly equal to the size of the surface of the substrate to be treated which is mounted on the holding surface of the holding means.

Also, the effective area of light irradiation is more preferably selected so as to be larger than the size of the surface of the substrate to be treated which is mounted on the holding surface of the holding means. Because the peripheral sections of the effective area of light irradiation have a greater heat release than sections near the center, the peripheral sections have a lower temperature. Uniform heating of the EL layer is possible, though, by selecting the size of the effective area of light irradiation as mentioned previously.

Furthermore, according to the invention the apparatus for producing thin-film EL devices is provided with the holding means, the light-irradiating means, and driving means for moving the holding means within the plane in which the holding means is situated. The light-irradiating means includes a light source constructed in a plane parallel to the holding surface and a reflecting panel for condensing and reflecting light from the light source toward the holding surface of the holding means. Annealing is performed by holding the substrate to be treated with the holding means and irradiating it with light from the light source while moving the holding means by the driving means to irradiate the light over roughly the entire surface of the substrate to be treated which is held by the holding means.

Furthermore, according to the invention the apparatus for producing thin-film EL devices is provided with the holding means, the light-irradiating means, and driving means for moving the light-irradiating means within the plane in which the light-irradiating means is situated. The light-irradiating means includes a light source and a reflecting panel of the types mentioned above. Annealing is performed by holding the substrate to be treated with the holding means and irradiating it with light from the light source while moving the light-irradiating means by the driving means to irradiate the light over roughly the entire surface of the substrate to be treated which is held by the holding means.

Since the light is condensed during the annealing treatment using this type of apparatus, the temperature at the section of light irradiation increases relatively rapidly. It also reaches a relatively high temperature. The driving means provided to move either the holding means or the light-irradiating means allows heating of roughly the entire surface of the substrate to be subjected to annealing treatment.

Thus, according to the invention, annealing treatment of an EL layer is performed by irradiation of light which contains rays in the absorption wavelength band of the electrode material of which the electrodes are made, in order to apply an electric field to the EL layer. The irradiated light is absorbed by the electrodes and stored as heat energy, thus efficiently heating the EL layer. As a result, the time required for the annealing treatment is shortened, and a device with a high luminance may be obtained with irradiation of light to the same setting temperature as according to the prior art. In addition, a high luminance may be obtained even when annealing treatment is performed under the critical temperature at which deformities occur in the translucent substrate on which the EL layer and electrodes are formed.

Furthermore, according to the invention indium tin oxide is selected as the electrode material, and light with a peak wavelength in the wavelength band of from 1.1 to 1.5 μm is selected as the light. This has been found to provide the effect described above.

Furthermore, according to the present invention the temperature-elevating rate at the time of annealing treatment is selected within a range of 200° C. to 600° C. per minute, and preferably it is selected within a range of 400° C. to 500° C. per minute. This has been found to improve the luminance by 10% or more, shorten the treatment time for greater productivity, and facilitate temperature control.

Furthermore, according to the invention the light irradiation is terminated immediately after the EL layer reaches a prescribed temperature. This has also been found to provide the effect described above, and further improve productivity.

Furthermore, according to the invention the annealing treatment described above is performed in an inert gas atmosphere. One of $N_2$, Ar or He, or a mixture of at least two thereof, is selected as the inert gas. This makes it possible, in a relatively low-cost way, to eliminate irregularities in the luminescence which tend to occur under the influence of oxygen during the heating.

Furthermore, according to the invention the light is irradiated over roughly the entire surface of the substrate to be subjected to annealing treatment, which is held by the holding means. Consequently, bulk and uniform annealing treatment is made possible.

Furthermore, according to the invention the light is irradiated on an area larger than he surface of the substrate to be treated. This makes even more uniform annealing treatment possible.

Furthermore, according to the invention the light from the light source is condensed and irradiated toward the substrate which is held by the holding means. The light-irradiating means which includes the light source and the reflecting panel is moved by the driving means to allow the light to be irradiated over roughly the entire surface of the substrate to be treated which is held by the holding means. Or, alternatively, the holding means is moved by the driving means to allow the light from the light source to be irradiated over roughly the entire surface of the substrate to be treated which is held by the holding means. Since the light from the light source is condensed and irradiated in this manner, the temperature at the light-irradiated section may be increased rapidly and may reach a high temperature.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
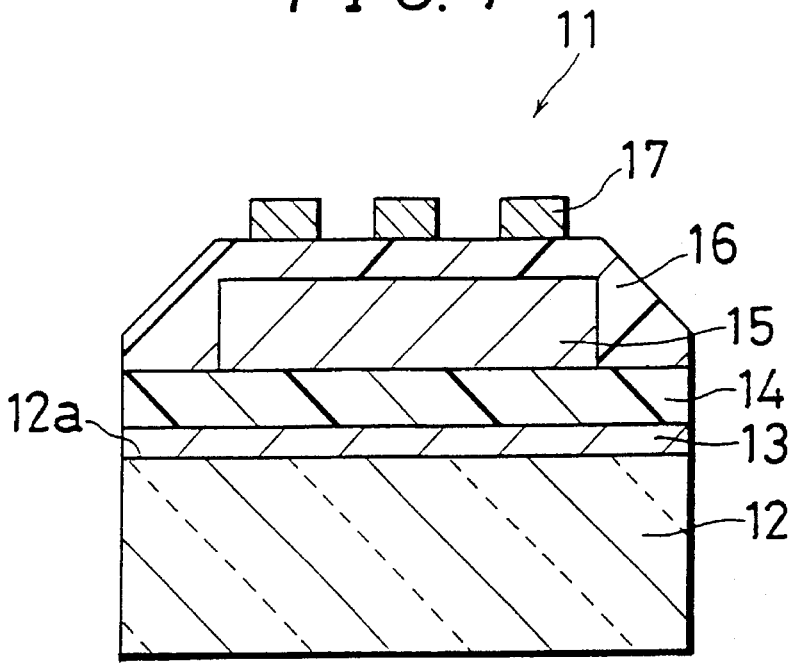
FIG. 1 is a cross-sectional view of the construction of a thin-film EL device 11 prepared based on a method of producing thin-film EL devices according to an embodiment of the invention.

Now referring to the drawings, preferred embodiments of the invention are described below.

FIG. 1 is a cross-sectional view of the construction of a thin-film EL device 11 prepared based on the method of producing thin-film EL devices according to an embodiment of the present invention. The thin-film EL device 11 comprises a translucent substrate 12, a lower electrode 13, a lower insulating layer 14, an EL layer 15, an upper insulating layer 16 and an upper electrode 17.

On one surface 12*a* of the translucent substrate 12 which is made of, for example, glass and has a size of 10 cm×8 cm, there are laminated a plurality of mutually parallel band-shaped lower electrodes 13. The lower electrodes 13 are made of, for example, ITO. A lower insulating layer 14 is laminated to cover the lower electrodes 13 on the surface 12*a* of the translucent substrate 12. The lower insulating layer 14 is made of, for example, $SiO_2$, $SiN_x$, $Ta_2O_5$, $SrTiO_3$ or the like. On a prescribed area of the lower insulating layer 14 there is laminated an EL layer 15 consisting of a host material made of, for example, ZnS in which are incorporated luminescence centers formed of Mn. The prescribed area is the area corresponding to the display screen, in the case where the thin-film EL device 11 is used as a display device. On the lower insulating layer 14 there is laminated an upper insulating layer 16 which covers the EL layer 15. The upper insulating layer 16 is made of, for example, the same material as the lower insulating layer 14. On the upper insulating layer 16 there are laminated a plurality of band-shaped upper electrodes 17 in a direction orthogonal to the lower electrodes 13. The upper electrodes 17 are made of, for example, aluminum.

This type of thin-film EL device 11 produces a display upon the application of an alternating voltage between the lower and upper electrodes 13, 17. That is, when an alternating voltage at or above the threshold voltage at which the EL layer 15 begins to luminescence is applied to the electrodes 13, 17 to produce an electric field between the electrodes 13, 17, the EL layer 15 between the electrodes 13, 17 luminescences. On the other hand, when an alternating voltage is applied which does not reach the threshold voltage, not enough electric field for exciting the luminescence centers is produced and the EL layer 15 between the electrodes 13, 17 does not luminescence. Consequently, by controlling the applied voltage, it is possible to create a display by combining stages of luminescence/non-luminescence. Thus, the constitution of this embodiment makes a matrix display possible.

Figure 2:
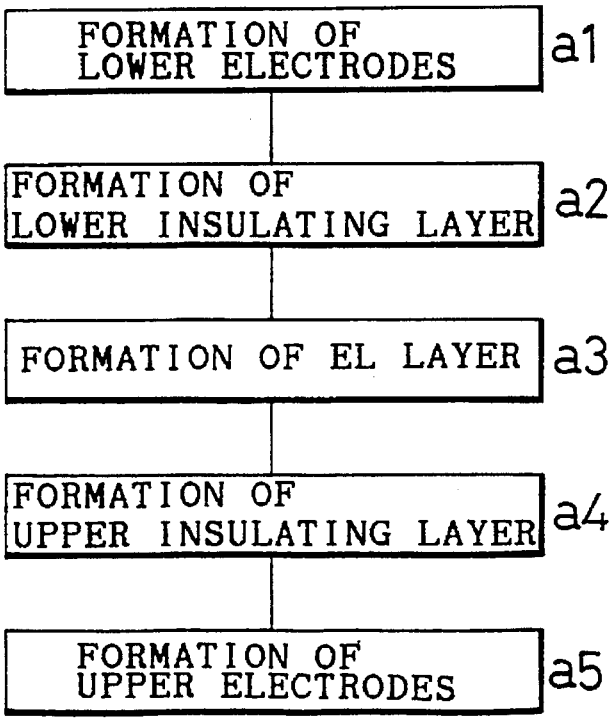
FIG. 2 is a flow diagram showing a method of forming the thin-film EL device 11.
Figure 3A:
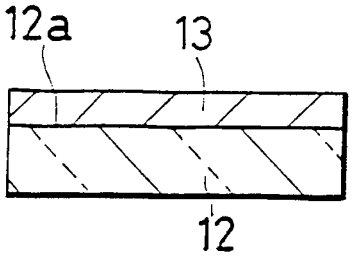
FIGS. 3A through 3E are cross-sectional views for a step-by-step explanation of the forming method.

FIG. 2 is a flow diagram showing a method of forming the thin-film EL device 11. FIGS. 3A through 3E are cross-sectional views for a step-by-step explanation of the process of the method. In step a1, as shown in FIG. 3A, the lower electrodes 13 are formed on one surface 12*a* of the translucent substrate 12. The lower electrodes 13 are first formed as a film of a lower electrode material on the entire surface of the surface 12*a* by, for example, sputtering, electron beam evaporation or spraying to a thickness selected in the range of 150 to 300 nm, and then the formed lower electrode material film is patterned into the shapes described earlier by photoetching.

Figure 3B:
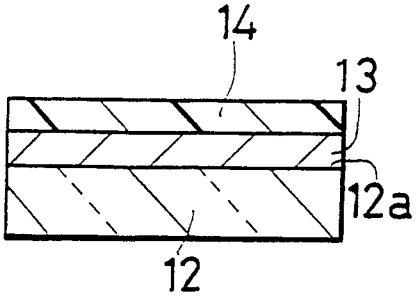

In step 2*a*, as shown in FIG. 3B, the lower insulating layer 14 is formed to cover the lower electrodes 13 on the surface 12*a* of the translucent substrate 12. The lower insulating layer 14 is formed as a film by, for example, sputtering, to a thickness selected in the range of 200 to 500 nm.

Figure 3C:
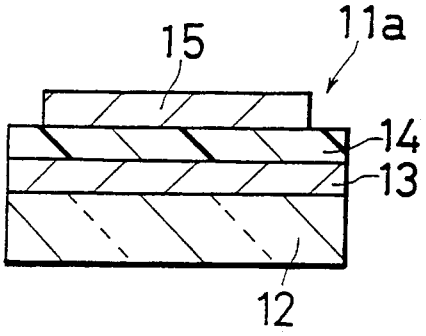

In step 3*a*, as shown in FIG. 3C, the EL layer 15 is formed on a prescribed area of the lower insulating layer 14. The EL layer 15 is prepared by, for example, electron beam evaporation. For example, pellets are prepared from a material made by adding 0.3 to 0.6 wt% of Mn to ZnS, the pellets are vaporized, the substrate for the deposition is kept at 200° to 300° C., and the film is formed to a thickness selected in the range of 500 to 1000 nm.

Figure 3D:
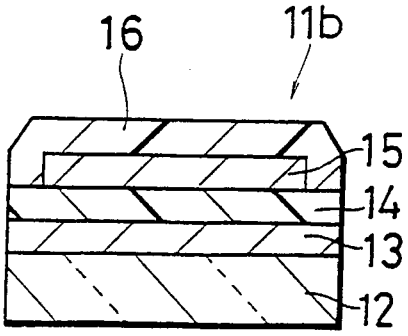
Figure 3E:
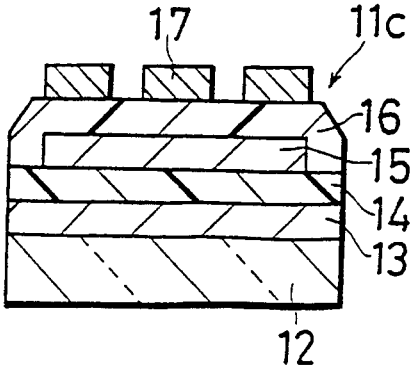

In step a4, as shown in FIG. 3D, an upper insulating layer 16 is formed to cover the EL layer 15 on the lower insulating layer 14. The upper insulating layer 16 is formed, for example, in the same manner as the lower insulating layer 14. In step a5, as shown in FIG. 3E, the upper electrodes 17 are formed on the upper insulating layer 16. The upper electrodes 17 are prepared, for example in the same manner as the lower electrodes 13, by forming a film of an upper electrode material on the entire surface of the upper insulating layer 16 prior to patterning.

It should be noted that according to the invention the annealing treatment performed on the EL layer 15 is carried out by a method using the annealing apparatus 21 described hereunder, and this annealing treatment is performed after formation of the EL layer 15. That is, any one of the substrates at the three stages, 11*a*, 11*b* or 11*c* shown in FIGS. 3C to 3E, may be the substrate which is subjected to annealing treatment.

The annealing treatment performed on the EL layer 15 consists of heating the EL layer 15 to improve the crystallinity of the host material while rendering more uniform the distribution of luminescence centers in the host material. This type of annealing treatment preferably causes no heat deformation or other problems in the structural materials present with the EL layer 15. For example, when Al is used as the upper electrodes 17 as in this embodiment, there is a risk of deformation in the upper electrodes 17 due to fusion of the Al by the annealing treatment described hereunder. As a result, in the case of this embodiment, the substrate 11*a* or 11*b* is preferably used as the substrate for annealing treatment. In cases where, for example, ITO is used as the upper electrodes 17, the substrate 11*c* may be used as the substrate for annealing treatment because ITO is less prone to fusion than is Al. The explanation which follows refers to an example in which the substrate 11*b* is the substrate for annealing treatment.

Figure 4:
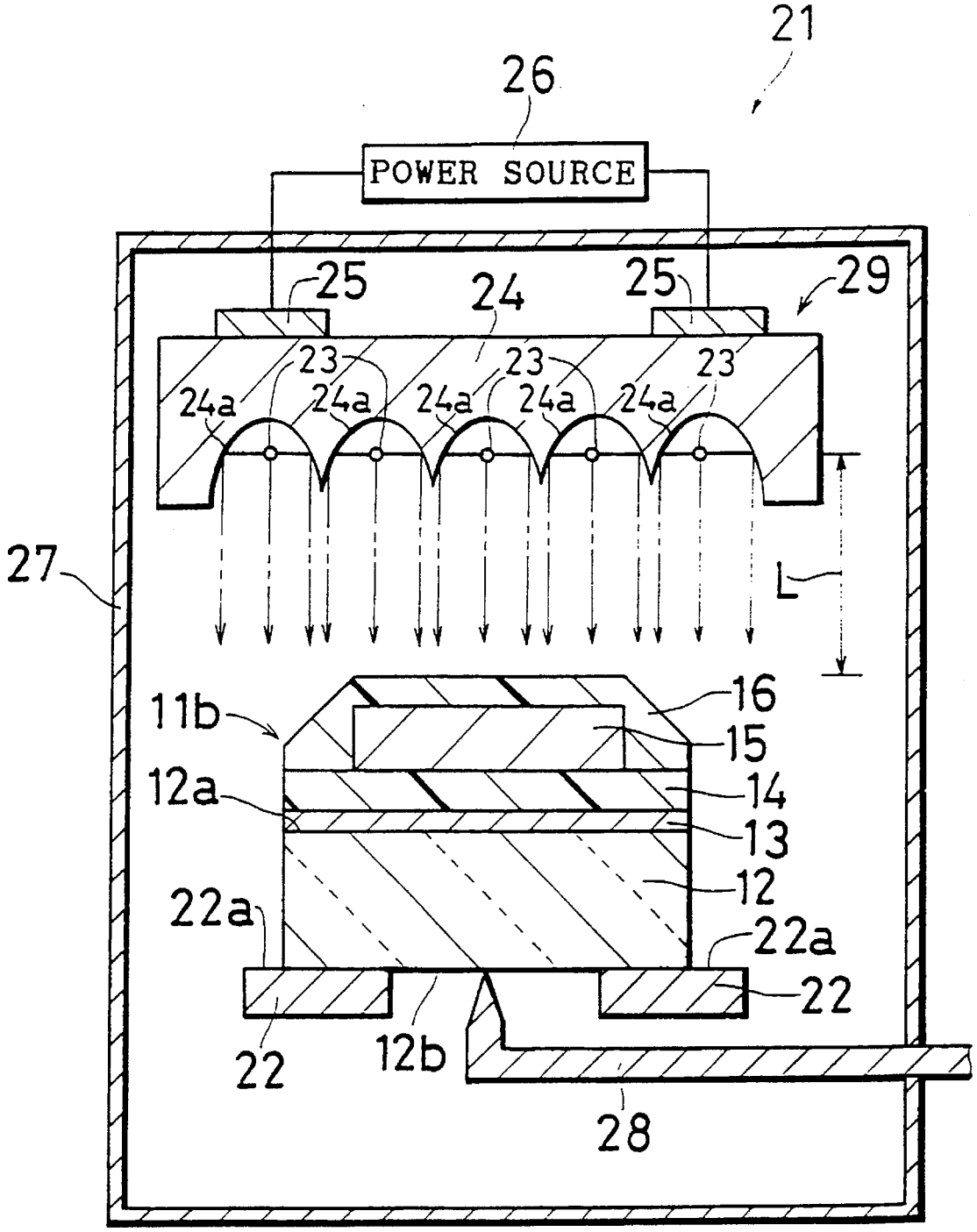
FIG. 4 is a schematic cross-sectional view of the construction of an annealing apparatus 21 for the preparation of the thin-film EL device 11.
Figure 5:
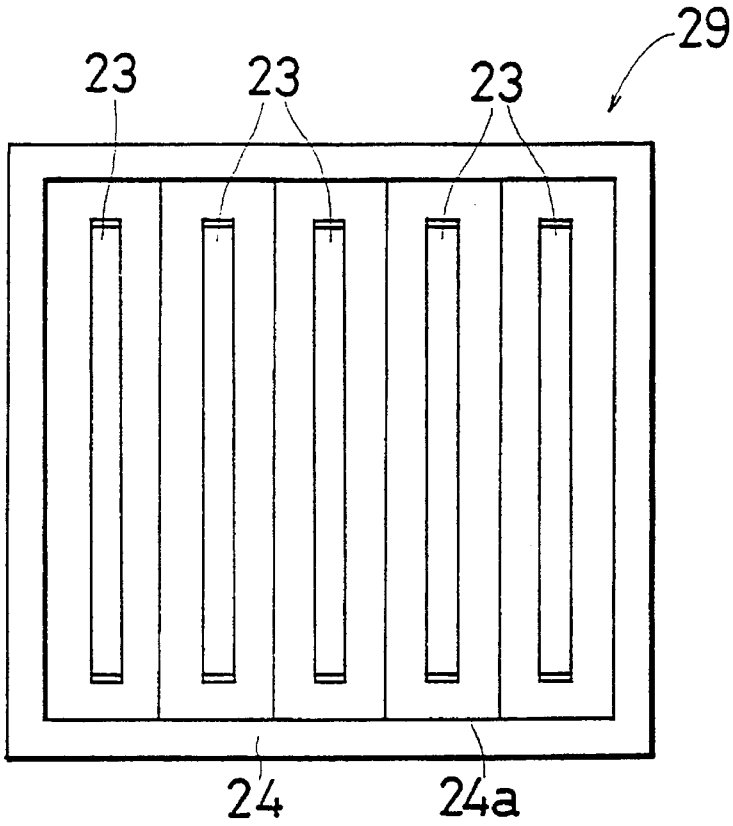
FIG. 5 is a plan view of the light irradiation surface of the light-irradiating means 29.
Figure 6:
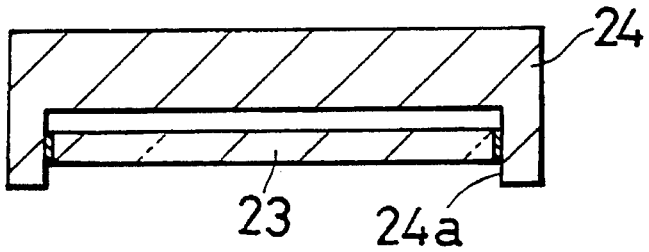
FIG. 6 is a cross-sectional view of the light sources 23 and the reflecting panel 24 taken from a direction orthogonal to the plane of FIG. 4.
Figure 7:
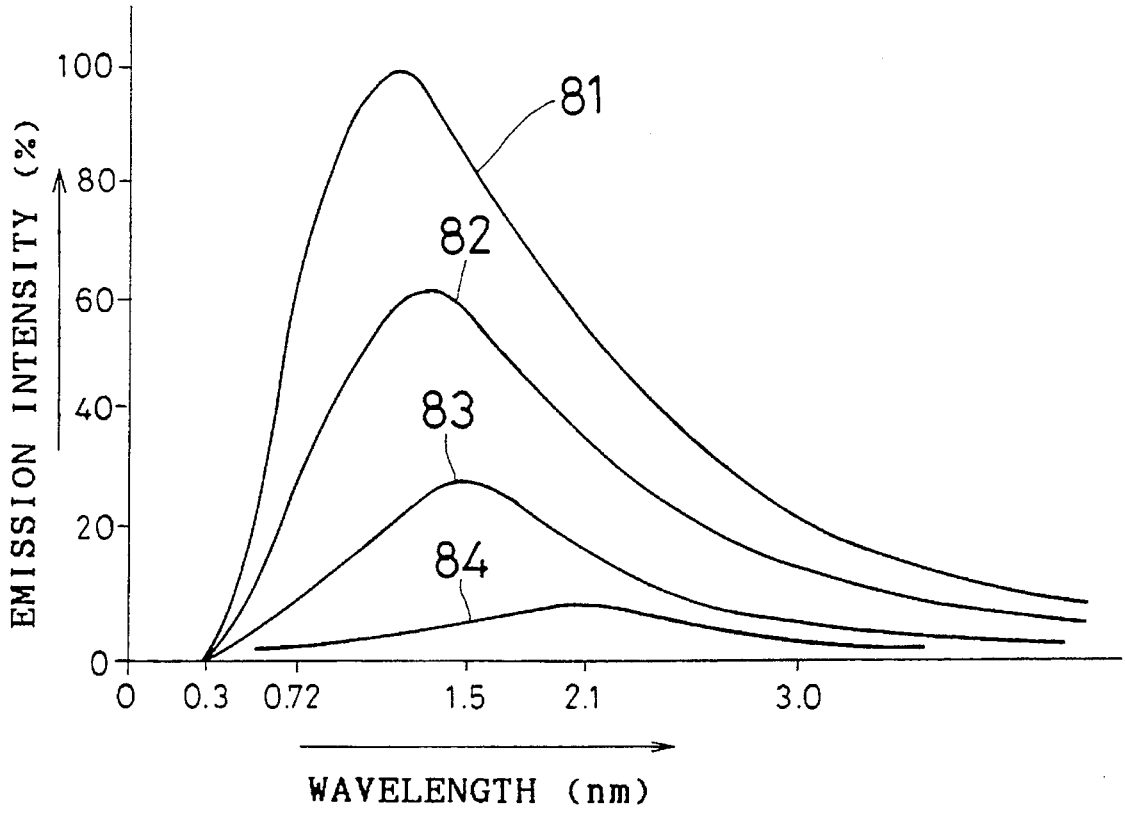
FIG. 7 is a graph showing emission spectra of the light sources 23 included in the above-mentioned annealing apparatus 21.

FIG. 4 is a schematic cross-sectional illustration of the construction of an annealing apparatus 21 for the preparation of the thin-film EL device 11. FIG. 5 is a plan view of the light irradiation surface of the light-irradiating means 29, and FIG. 6 is a cross-sectional view of the light sources 23 and the reflecting panel 24 taken from a direction orthogonal to the plane of FIG. 4. FIG. 7 is a graph showing emission spectra of the light sources 23 included in the annealing apparatus 21. The annealing apparatus 21 comprises a stage 22, a housing 27 and light-irradiating means 29. The substrate 11*b* for annealing treatment is mounted on the top surface 22*a* of the stage 22. The light-irradiating means 29 is provided above and opposite the surface 22*a* of the stage 22.

The light-irradiating means 29 comprises a plurality of light sources 23, a reflecting panel 24, a pair of electrodes 25 and a power source 26. The plurality (5 in this embodiment) of light sources 23 are bar-shaped, as shown in FIG. 5, and are positioned at mutually equal spacing in an area of a plane parallel to the surface 22*a* of the stage 22 on which the substrate 11*b* is mounted and opposite roughly the entire surface of the substrate 11*b* mounted on the stage 22. These light sources 23 irradiate light which includes rays in the absorption wavelength band of ITO, the electrode material of the lower electrodes 13, and in this embodiment, an infrared lamp (Model Pss68V, manufactured by ULVAC SINKU-RIKO, INC.) is used, which encloses a tungsten filament in a quartz glass tube.

The light sources 23 display the emission spectra as shown in FIG. 7. The solid lines 81–84 is set at 100%, 75%, 50% and 25%, respectively, relative to the maximum applicable power. The wavelength at which emission intensity reaches the maximum value is 1.15 μm, 1.30 μm, 1.55 μm or 2.00 μm. Therefore, by adjusting the inputted power one can select a peak wavelength. Taking the life of a lamp into consideration, the inputted power is preferably set within 70% of the maximum applicable power.

The transmittance and reflectance spectrum of ITO is given in J. Electrochem. Soc.: SOLID-STATE SCIENCE AND TECHNOLOGY, VOL. 119, No. 10, (October 1972), pp. 1368–1374, "Highly Conductive, Transparent Films of Sputtered In(2-x)Sn(x)O(3-y)", and the results of calculating the absorptance at each wavelength from this spectrum are shown in Table 1.

TABLE 1

| Measuring wavelength | Transmittance (found) A (%) | Reflectance (calculated) B (%) | Reflectance (found) C (%) | Absorptance D (%) |
|---|---|---|---|---|
| 900 nm | 77 | 23 | 10 | 13 |
| 1100 nm | 64 | 36 | 5 | 31 |
| 1300 nm | 36 | 64 | 8 | 56 |
| 1500 nm | 10 | 90 | 43 | 47 |
| 1700 nm | 5 | 95 | 62 | 33 |

If A is defined as the transmittance (found) based on the transmittance spectrum given in the above-mentioned document, then the reflectance B (calculated) is found by the equation B=100–A. Also, if C is defined as the reflectance (found) based on the reflectance spectrum given in the document, then the absorptance D is found by the equation D=B–C. From the absorptance D calculated in this manner it is determined that ITO absorbs 30% to 40% of the infrared light in the wavelength band of about 1.2 μm. The light irradiated from the infrared lamp is in the infrared region and exhibits an emission spectrum with a peak at a wavelength of 1.15 μm, and the inputted power may be adjusted to shift the peak to the long wavelength end. The absorptance of infrared light as described in the aforementioned document is believed to differ depending on the quality and method of formation of the ITO.

The reflecting panel 24 reflects light from the light sources 23 toward the surface of the substrate 11*b* mounted on the stage 22, and it has a plurality (5 in this embodiment) of concavities 24*a*. As shown in FIGS. 4 and 6, the cross-sectional shape of the concavities 24*a* is parabolic in the direction orthogonal to the lengthwise direction of the concavities 24*a*, and their cross-sectional shape along the lengthwise direction is rectangular. The plurality of light sources 23 are respectively situated along the plurality of the concavities 24*a*. Optimization of the shape of the concavities 24*a* will allow uniform irradiation of light from the light sources 23 onto the surface of the substrate 11*b* mounted on the stage 22.

Proper selection of the number, length and spacing of the light sources 23, the number, length and spacing of the concavities 24*a* of the reflecting panel 24, and the distance between the light sources 23 and the surface of the substrate 11*b* makes it possible to select the area of light irradiation when light is irradiated from all of the light sources 23. The area of light irradiation is intended to mean the effective area of light irradiation which is within the total area of light irradiation at a prescribed distance from the light source 23 and at or greater than a prescribed strength of light intensity. In this embodiment, the area of light irradiation was 20 cm×12 cm, which was larger than the area of the translucent substrate 12. The temperature at the peripheral sections within the area of light irradiation is lower because heat release is greater at the peripheral sections than at the sections near the center. Thus, by making the area of light irradiation larger than the area of the translucent substrate 12, it is possible to perform annealing treatment of the EL layer in a more uniform manner. The distance L between the plane of the light sources 23 and the surface of the substrate 11*b* was set to 10 cm. This is selected, for example, by moving either the stage 22 or the light-irradiating means 29 up or down.

A power voltage is supplied to the light sources 23 from the power source 26 via a pair of electrodes 25. Light is thus irradiated from the light sources 23. The stage 22 on which the substrate 11*b* is mounted and the light sources 23, light reflecting panel 24 and electrodes 25 constituting the light-irradiating means 29 are all situated in the housing 27. Also, a thermocouple 28 is used to measure the temperature at the other surface 12*b* opposite the surface 12*a* of the translucent substrate 12 adjacent to the substrate 11*b*.

Figure 8:
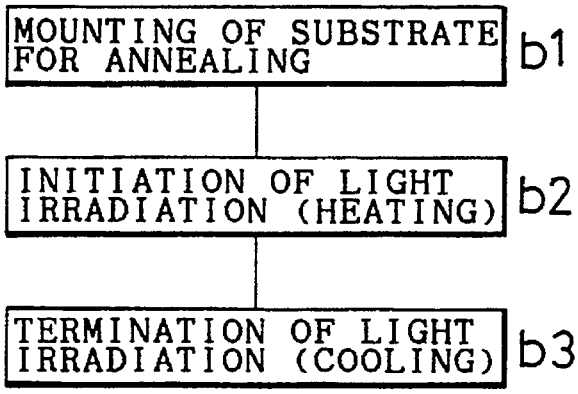
FIG. 8 is a flow diagram showing the steps of annealing treatment.

FIG. 8 is a flow diagram showing the steps of annealing treatment. In step b1, the substrate 11*b* is mounted on the stage 22. At this time, the distance L is set to 10 cm. In step b2, a power voltage is applied from the power source 26 to initiate light irradiation toward the substrate 11*b*. The area of the substrate which is irradiated with light is thus heated. At this time, the voltage applied to the light sources 23 is adjusted so that the temperature-elevating range as measured by the thermocouple 28 is within a range of 100° C. to 600° C. per minute.

In this embodiment, the temperature-elevating rate was 200° C./min at an inputted power of 3 kw, 300° C./min at an inputted power of 5 kw, and 400° C./min at an inputted power of 10 kw. This light irradiation heats the substrate 11*b* to a prescribed temperature. The results of measurement by the thermocouple 28 are used to determine whether the prescribed temperature has been reached.

In step b3, the power voltage from the power source 26 is cut off to terminate the light irradiation. This cools the substrate 11*b*.

Figure 9:
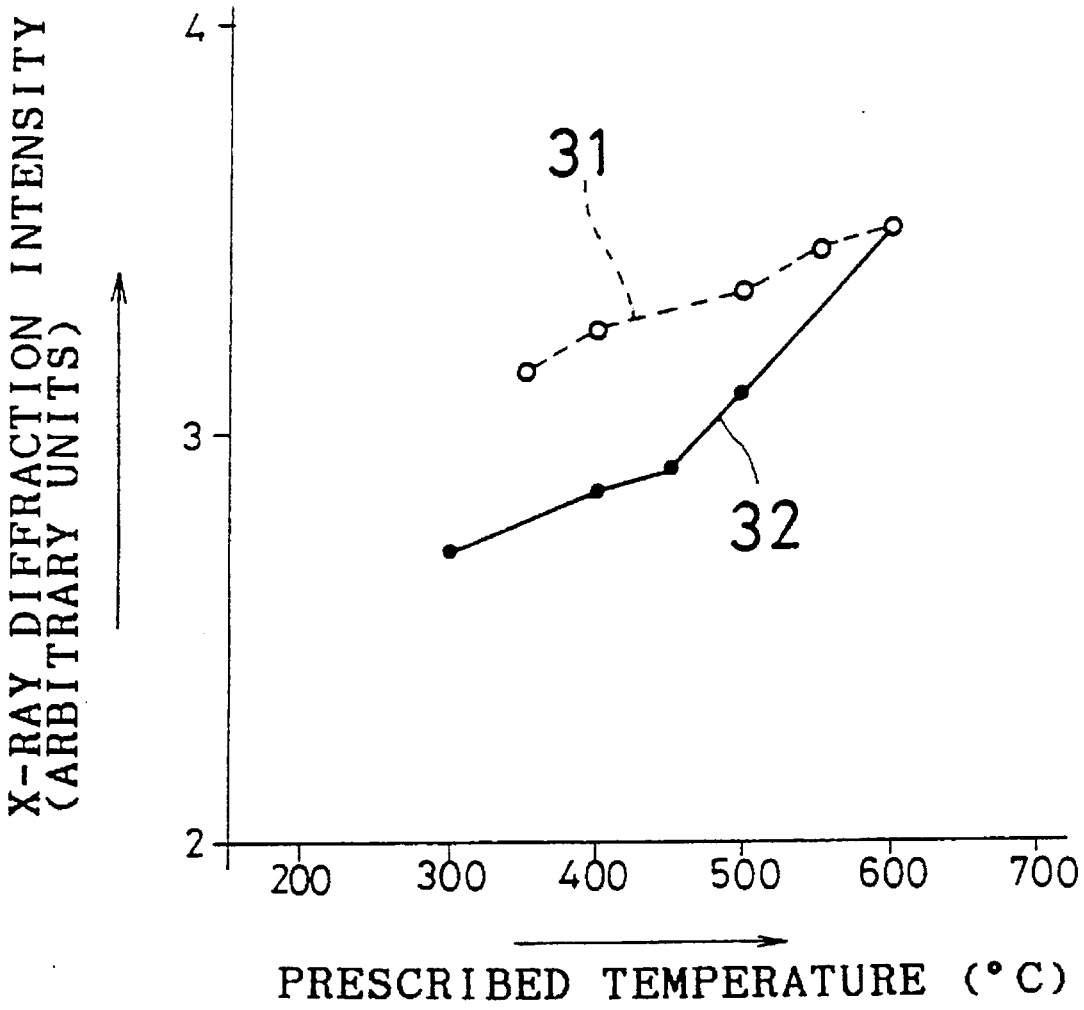
FIG. 9 is a graph showing the relationship between the prescribed temperature at the time of annealing treatment and the intensity of X-ray diffraction on an EL layer 15 subjected to annealing treatment at that temperature.

FIG. 9 is a graph showing the relationship between the prescribed temperature at the time of annealing treatment and the intensity of X-ray diffraction on an EL layer 15 subjected to annealing treatment at that temperature. The temperature-elevating rate at the time of annealing treatment was 400° C./min, and the X-ray diffraction intensity was expressed by selecting the diffraction intensity value of the (111) plane of ZnS. The broken line 31 represents the results obtained by annealing treatment according to the embodiment, and the solid line 32 represents the results of conventional annealing treatment as a comparison. The conventional annealing treatment involved a method in which heating was performed in a vacuum atmosphere until reaching a given temperature, after which each substrate was kept for one hour at that temperature and then allowed to cool naturally.

From FIG. 9 it is clear that, at all of the prescribed temperatures studied, the X-ray diffraction intensities were stronger, and thus the crystallinities were higher, in the cases of EL layers 15 subjected to annealing treatment according to the embodiment. Furthermore, at relatively low temperatures, a greater effect of improvement in the crystallinity was observed. This is believed to be because the temperatures were measured at the other surface 12*b* of each translucent substrate 12, and did not represent measurement of the temperatures of the EL layers 15 themselves, thus giving lower values than would have been measured for the temperatures of the EL layers 15 themselves.

Figure 10:
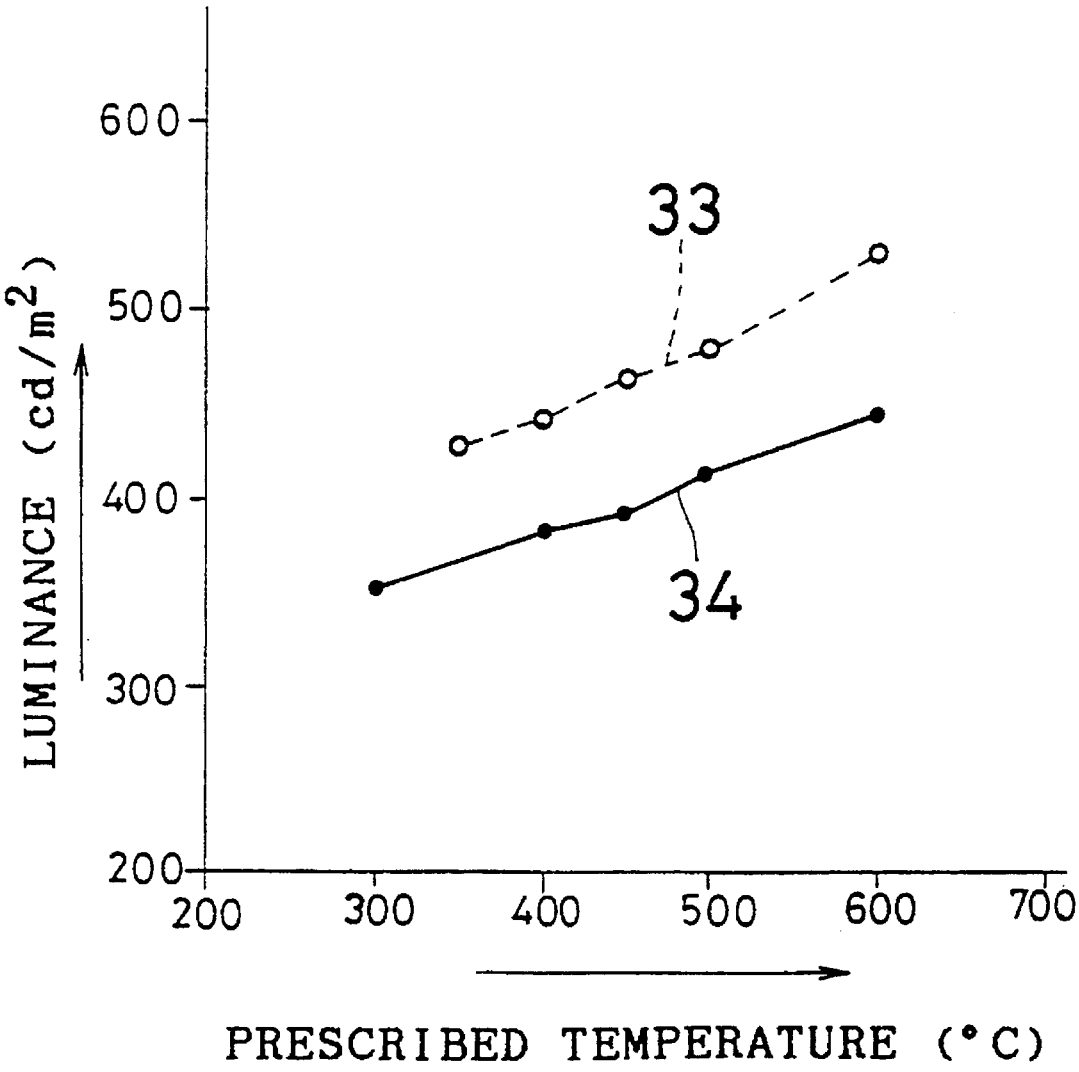
FIG. 10 is a graph showing the relationship between the setting temperature at the time of annealing and the luminance of a prepared thin-film EL device 11.

FIG. 10 is a graph showing the relationship between the prescribed temperature at the time of annealing treatment and the luminance of a prepared thin-film EL device 11. The temperature-elevating rate was 400° C./min as in the case described above. The luminance was measured at the time of application of an alternating voltage of 100 Hz to the electrodes 13, 17. The broken line 33 represents the results obtained by annealing treatment according to the embodiment, and the solid line 34 represents the results of conventional annealing treatment as a comparison. The results shown in the graph in FIG. 10 are listed in numerical form in Table 2.

TABLE 2

| Prescribed temperature | Luminance of thin-film EL devices (cd/m²) Comparison | Embodiment |
|---|---|---|
| 350 | — | 425 |
| 400 | — | 440 |
| 450 | 390 | 460 |
| 500 | 410 | 475 |
| 600 | 440 | 525 |

From FIG. 10 and Table 2 it is clear that the luminance was greater and was improved by about 20% in the case of the thin-film EL devices subjected to annealing treatment according to the embodiment. This shows that the prescribed temperature at the time of annealing treatment may be lowered to obtain the same luminance as according to the prior art; consequently, whereas the prior art has required the use of, as the translucent substrate 12, expensive glass substrates such as non-alkali glass, which are resistant to deformation, which have high deformation points at which the substrates begin to deform and which are able to withstand high-temperature treatment, in contrast the annealing treatment according to the embodiment makes it possible to use low-cost soda glass or the like which is relatively prone to deformation, thus allowing reduction in the production cost of the thin-film EL devices. It is understood from FIG. 10 that, for example, performing annealing treatment according to the embodiment with the prescribed temperature at 400° C. gives a luminance at the same level as when annealing treatment was performed by the prior art method with the prescribed setting temperature at 600° C.

The deformation points as described above are intended to mean temperatures which are used as reference when the temperature of annealing treatment is set at temperatures exceeding those of the deformation points, deformation such as a warp occurs due to internal stress. It is, however, to be noted that the deformation points are distinct from "softening points" as generally referred to.

Figure 11:
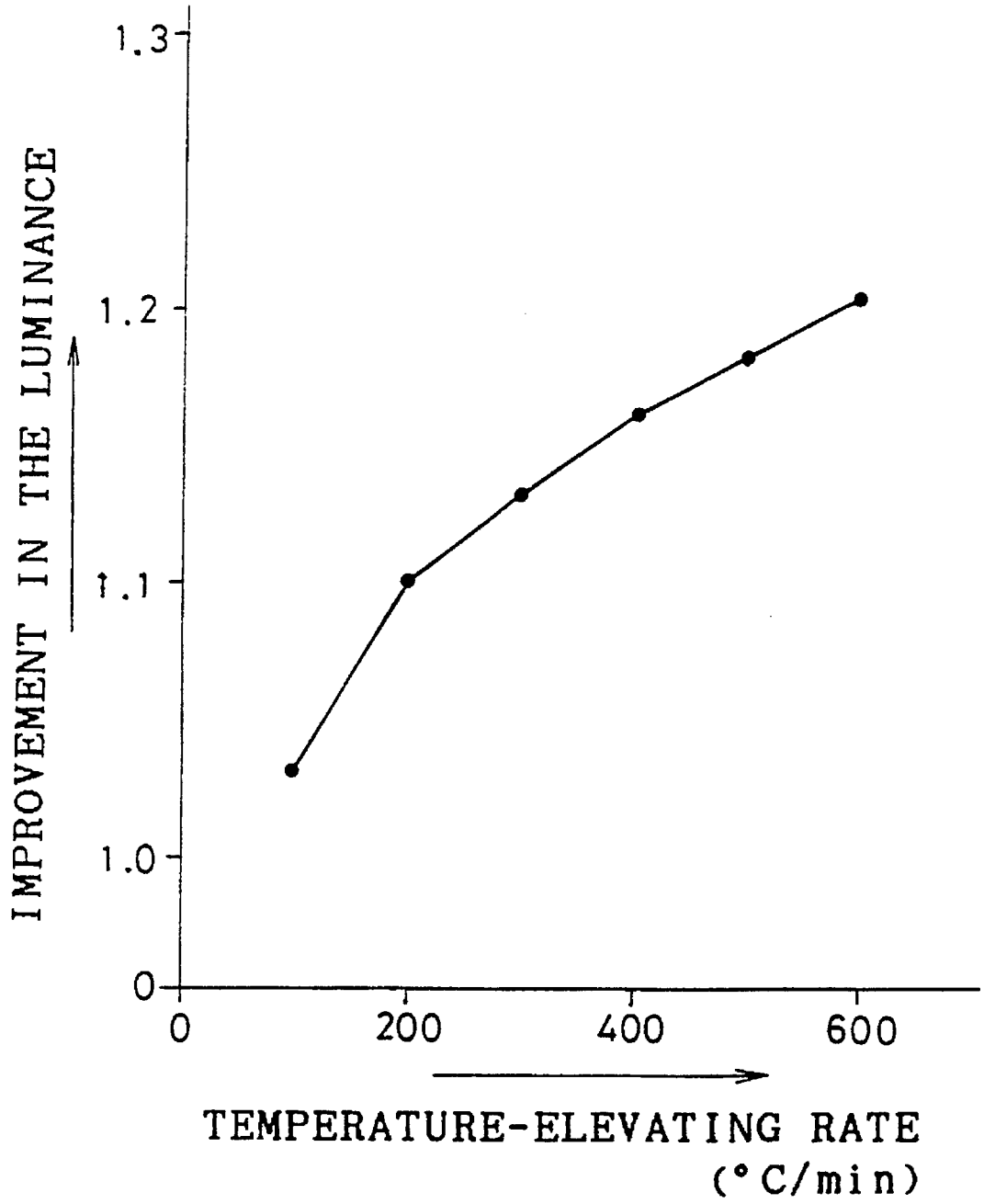
FIG. 11 is a graph showing the relationship between the temperature-elevating rate and the degree of improvement in the luminance.

FIG. 11 is a graph showing the relationship between the temperature-elevating rate and the degree of improvement in the luminance. Thin-film EL devices 11 were prepared with temperature-elevating rates during annealing treatment of 100° C., 200° C., 300° C., 400° C., 500° C. and 600° C. per minute, and the luminance of each device was evaluated. The prescribed temperature was 400° C. Also, the luminance in each case is expressed as an improvement in the luminance, in terms of the ratio to the luminance of a thin-film EL device subjected to annealing treatment according to the prior art which is defined as 1.

From FIG. 11 it is understood that the luminances were higher than those of the prior art for all the temperature-elevating rates. Furthermore, it is seen that the effect of improvement in the luminance is better at faster temperature-elevating rates. This is believed to be because when the temperature-elevating rate is relatively high, the results of measurement by the thermocouple cannot keep up with the rise in temperature, and thus there is a greater difference between the actual temperature of the EL layer 15 and the temperature measured by the thermocouple 28. It is also believed to be because when the temperature-elevating rate is relatively low, not only is there less of a difference between the actual temperature of the EL layer 15 and the temperature measured by the thermocouple 28, but also the temperature becomes roughly the same as according to the prior art, and therefore a similar luminance results.

Figure 12:
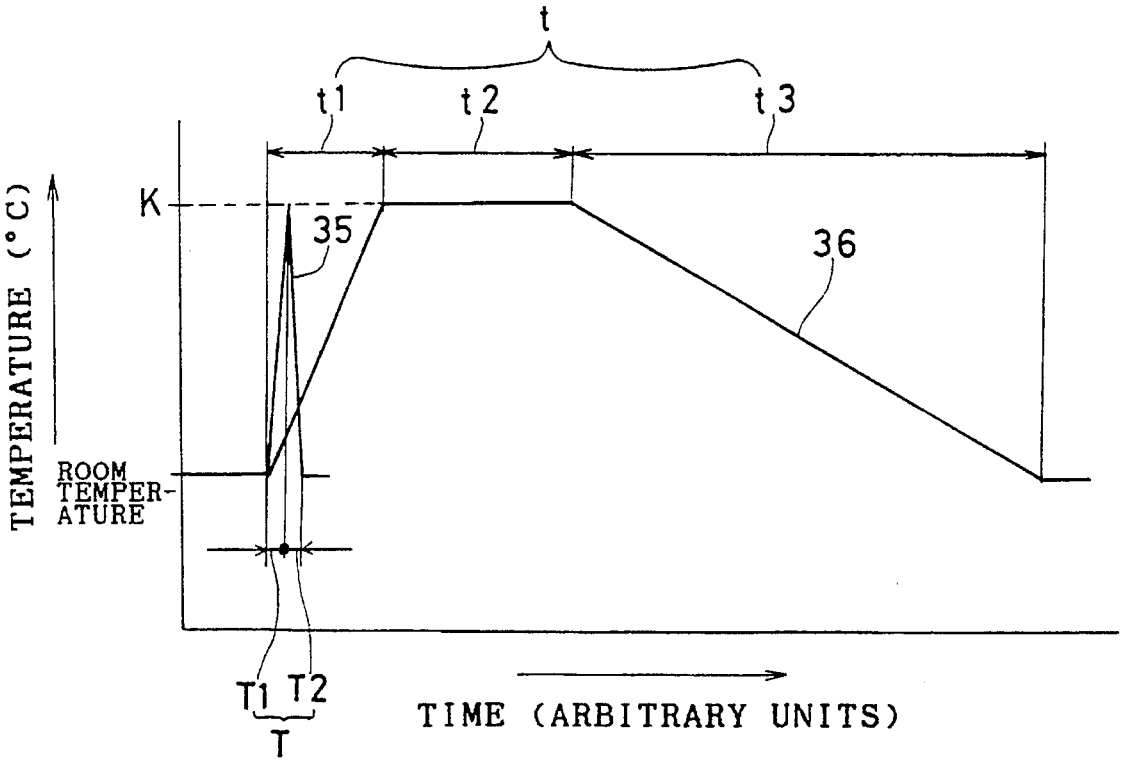
FIG. 12 is a graph showing the time required for annealing treatment.

FIG. 12 is a graph showing the times required for annealing treatment, for comparison between the embodiment and the prior art. The horizontal axis (e.g. "x" axis) is time and the vertical axis (e.g. "y" axis) is temperature. The solid line 35 represents annealing treatment according to the embodiment, and the solid line 36 represents annealing treatment according to the prior art. In the case of the embodiment, heating to the prescribed temperature K is immediately followed by cooling. For example, if the prescribed temperature K is 630° C., then the temperature elevation time T1 is 1.5 minutes and the temperature lowering time T2 is 3.5 minutes, for a total annealing treatment time T of 5 minutes. In contrast, in the case of the prior art, after heating to the prescribed setting temperature K, the temperature is maintained for a certain time prior to cooling. For example, if the temperature elevation time t1 is 1 hour, the temperature holding time t2 is 1.5 hours and the temperature lowering time t3 is 4.5 hours, then the total annealing treatment time t becomes 7 hours.

Assuming here that, for example, 60 substrates are treated in each annealing treatment according to the prior art, 0.143 substrates may be treated per minute. Since treatment of one substrate according to the embodiment requires 5 minutes, 0.2 substrates may be treated per minute. This gives a treatment efficiency of 1.4 times over the prior art.

Table 3 below shows the relationship between the temperature-elevating rates for annealing treatment according to the embodiment and the number of substrates which has been treated.

TABLE 3

| Temperature-Elevating Rate (τ/min) | Temperature Elevation Time T1 (min) | Temperature Lowering Time T2 (min) | Treatment Time T (min) | Treatment Number (Substrates/min) |
|---|---|---|---|---|
| 100 | 6 | 3.5 | 9.5 | 0.105 |
| 200 | 3 | 3.5 | 6.5 | 0.154 |
| 300 | 2 | 3.5 | 5.5 | 0.182 |
| 400 | 1.5 | 3.5 | 5 | 0.2 |
| 500 | 1.2 | 3.5 | 4.7 | 0.212 |
| 600 | 1 | 3.5 | 4.5 | 0.222 |

From Table 3 it is apparent that there is an improvement in productivity if the temperature-elevating rate is greater than 200° C./min.

Incidentally, although more substrates may be treated by increasing the size of the annealing apparatus of the prior art, it is difficult for a wide space in which the substrates are situated to be uniformly kept at a prescribed temperature, and therefore uniform annealing cannot be performed. With the annealing apparatus according to the embodiment, however, annealing treatment of a single substrate may be performed in a reliable manner, and since the treatment time is very short, such reliable annealing treatment may be performed with high efficiency.

Furthermore, the annealing treatment according to the embodiment may be made even more efficient by widening the area of light irradiation of the annealing apparatus, and therefore if, for example, 5 substrates can be subjected to annealing treatment simultaneously, it becomes possible to treat one substrate per minute, thus increasing the treatment efficiency by a factor of 7.

Figure 13:
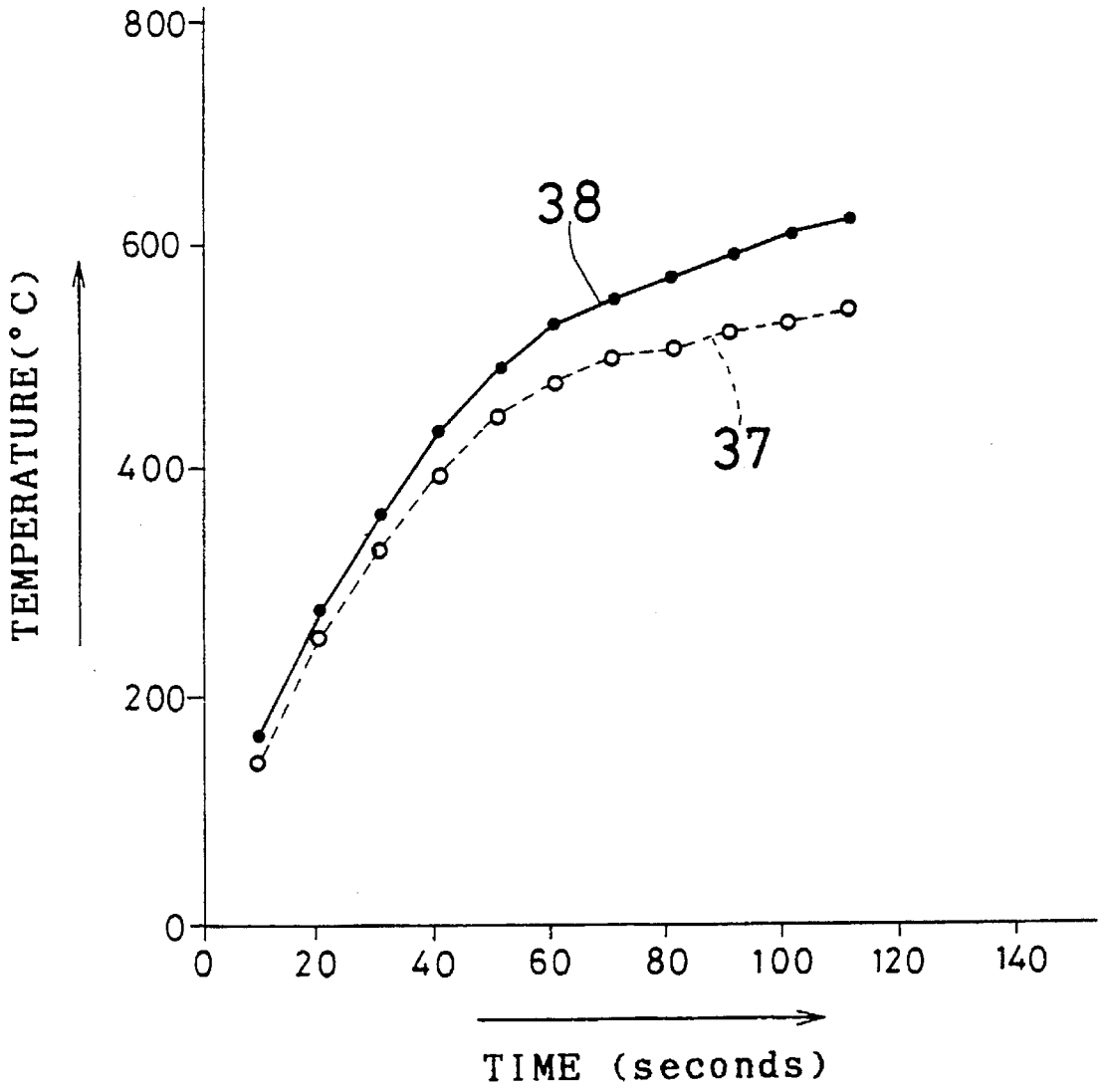
FIG. 13 is a graph showing the relationship between light irradiation time for light irradiation at a constant output and temperature as measured by a thermocouple 28.

FIG. 13 is a graph showing the relationship between light irradiation time for light irradiation at a constant output and temperature as measured by a thermocouple 28. The broken line 37 represents cases in which instead of the aforementioned substrate 11*b* there were used ITO-coated glass substrates placed on the stage 22, and the solid line 38 represents cases in which instead of the aforementioned substrate 11*b* there were used non-ITO-coated glass substrates placed on the stage 22. The measurement was made without contacting the thermocouple 28 with the glass substrates.

It is shown that with light irradiation for equal periods of time, the ITO-coated glass substrates represented by the broken line 37 have lower temperatures. This is believed to be because, since the irradiation is performed with infrared light containing rays in the absorption wavelength band of ITO, the light is absorbed by ITO, thus reducing the amount of heat energy passing through the glass substrate. Consequently, it is believed that the temperature of the ITO increased in the ITO-coated glass substrates. Based on this it is thought that the EL layers 15 formed on the lower electrodes 13 made of ITO had higher temperatures, and that therefore higher luminances were obtained than with the prior art even with annealing treatment at low temperatures.

According to the embodiment, the effect of the invention is achieved even if light irradiation is terminated immediately upon reaching the prescribed temperature. Therefore, it is thought that according to the prior art in which the temperature-elevating rate is as moderate as about 10° C./min, improvement in the crystallinity of the host material proceeds gradually and the diffusion of the luminescence centers occurs after improvement in the crystallinity, whereas according to the embodiment in which the temperature-elevating rate is drastic, in the range of 100° C. to 600° C. per minute, the improvement in the crystallinity and the diffusion of the luminescence centers are simultaneous and proceed in an efficient manner. It is believed that the same effect of the embodiment will be achieved even if the temperature is maintained for a certain period of time after reaching the prescribed temperature by light irradiation, as according to the prior art.

With respect to the prescribed temperature in annealing treatment, the higher the temperature, the better the improvement in luminance. Thus, the prescribed temperature is preferably set to be slightly lower than the maximum temperature that the translucent substrate 12 can endure. The temperature according o the embodiment is selected so as to be 600° C. or lower. This is because if it exceeds 600° C. deformities occur in the glass substrate used as the translucent substrate 12 of the thin-film EL device 11, and temperature control becomes difficult, thus risking deformity of the translucent substrate 12 when the temperature rises over the prescribed temperature. It is also because the power inputted to the light sources 23 must be increased for a higher prescribed temperatures, thus requiring a larger capacity power source 26, drastically shortening he life of the light sources 23, and raising the production cost for the thin-film EL device 11.

Also, the temperature-elevating rate is selected within a range of not less than 200° C./min for a 10% or greater improvement in the luminance with higher production efficiency and not greater than 600° C./min for easier temperature control, and preferably it is selected within a range of not less than 400° C./min for a shorter treatment time and improved production efficiency (where the production efficiency of 1.4 times over the prior art) and not more than 500° C./min for even easier temperature control.

Instances in which the annealing treatment according to the embodiment is performed in an inert gas atmosphere are also within the scope of the invention. The inert gas may be any one of $N_2$, Ar or He, or a mixture of at least any two thereof. The treatment is performed in an inert gas atmosphere to avoid luminescence irregularities believed to result from the influence of oxygen with heating to, for example, 400° C. or higher. Oxygen molecules pass through pinhole defects present in the upper insulating layer 16 and reach the EL layer 15. when the layer 15 is heated to a temperature of 400° C. or higher by the annealing treatment, the material of the layer will be subjected to oxidation, thus creating portions differing with respect to luminescence characteristics. According to the prior art, the annealing treatment is performed in a vacuum atmosphere to prevent such luminescence irregularities believed to be due to the oxygen. Though this method requires a costly vacuum unit, the embodiment may be realized using only a low cost gas feeding unit. As a specific example, the substrate to be subjected to annealing treatment is placed in a quartz tube which is then evacuated and replaced with $N_2$ gas prior to the annealing treatment. The annealing method is the same as described earlier.

Also, it is possible for the annealing treatment according to the embodiment to be performed in a vacuum atmosphere similar to that in the prior art. In this instance as compared with the annealing treatment of the prior art conducted in a vacuum atmosphere, higher providing can be obtained in the embodiment. This, however, requires a vacuum system that allows a space of annealing treatment to be also a vacuum atmosphere. In addition, a housing in which the substrates to be treated are situated must be made a vacuum atmosphere, Thus, the productivity is lower in comparison with the cases where the annealing treatment is performed in an inert gas atmosphere.

Figure 14:
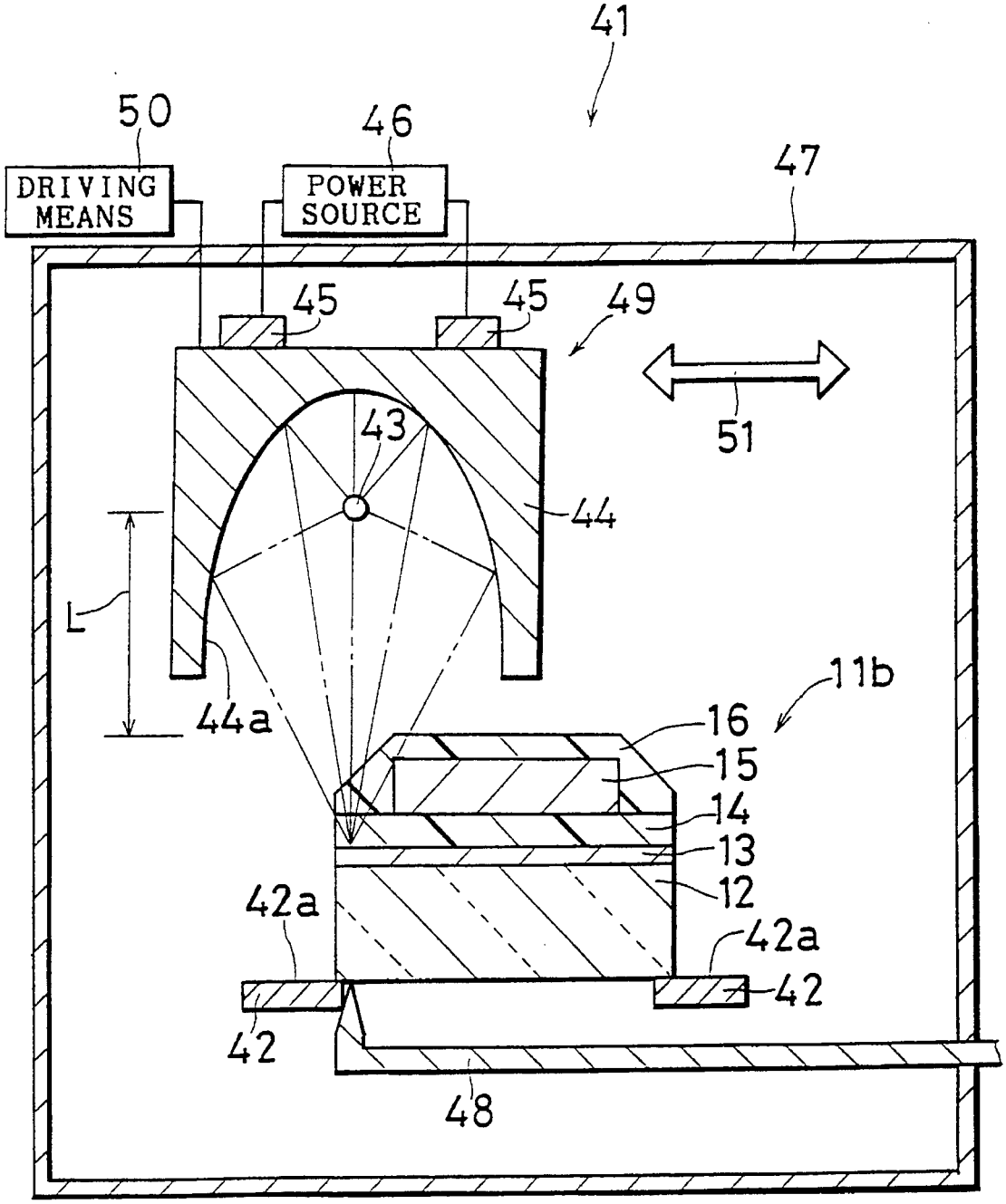
FIG. 14 is a schematic cross-sectional view of the construction of an annealing apparatus 41 according to another embodiment of the present invention.
Figure 15:
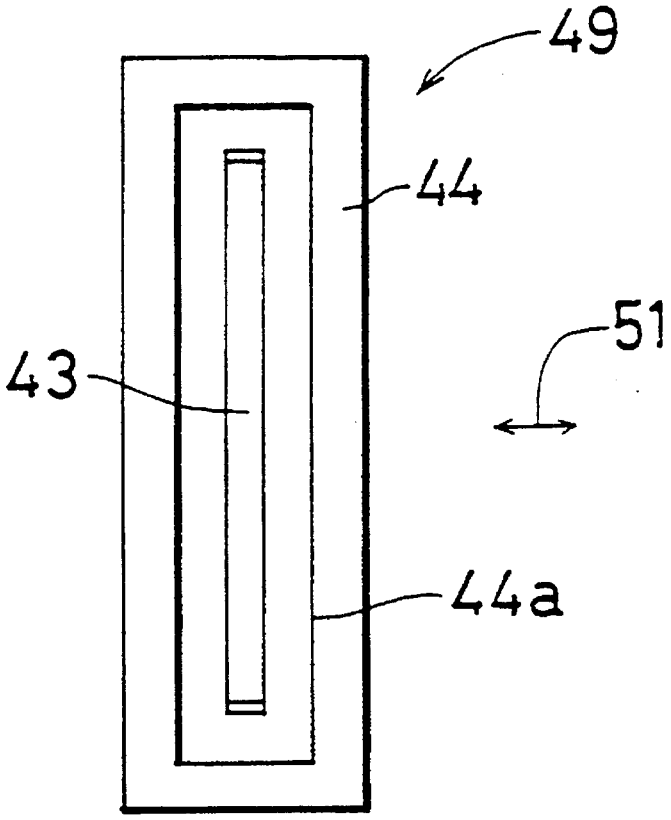
FIG. 15 is a plan view of the light irradiation surface of the light-irradiating means 49.
Figure 16:
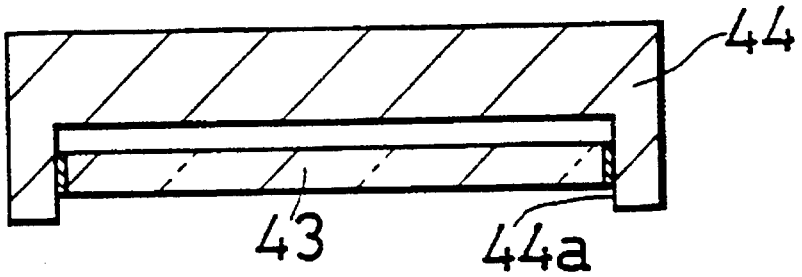
FIG. 16 is a cross-sectional view of the light source 43 and reflecting panel 44 taken from a direction orthogonal to the plane of FIG. 13.

FIG. 14 is a schematic cross-sectional illustration of the construction of another annealing apparatus 41 according to the invention. FIG. 15 is a plan view of the light irradiation surface of the light-irradiating means 49, and FIG. 16 is a cross-sectional view of the light source 43 and reflecting panel 44 taken from a direction orthogonal to the plane of FIG. 14. The annealing apparatus 41 comprises a stage 42, a housing 47, light-irradiating means 49 and driving means 50. The light-irradiating means 49 of this annealing apparatus 41 differs from the light-irradiating means 29 of the previous annealing apparatus 21, but the two apparatuses are otherwise identically constructed except for the provision of the driving means 50.

The light-irradiating means 49 includes one light source 43, a reflecting panel 44, a pair of electrodes 45 and a power source 46. The light source 43 is bar-shaped as shown in FIG. 15, and is made to have the same characteristics as the previously mentioned light source 23. In this embodiment, an infrared lamp (Model El10L, manufactured by ULVAC SINKU-RIKO, INC.) was used. The light source 43 is situated in a plane opposite the surface 42*a* of the stage 42 on which the substrate 11*b* is mounted.

The reflecting panel 44 reflects light from the light sources 43 toward the surface of the substrate 11*b* mounted on the stage 42, and it has one concavity 44*a*. As shown in FIGS. 14 and 16, the cross-sectional shape of the concavity 44*a* is parabolic in the direction orthogonal to the lengthwise direction of the concavity 44*a*, and its cross-sectional shape along the lengthwise direction is rectangular. The light source 43 is situated along the concavity 44*a*.

In this embodiment, 10 cm×5 cm was selected as the size of the translucent substrate 12 of the thin-film EL device 11*b*. Also, the area of light irradiation from the light source 43 was set to 26.5 cm×0.3 cm. The distance L between the light source 43 and the surface of the substrate 11*b* was set to 10 cm.

The driving means 50 is means for moving the light-irradiating means 49 in the direction indicated by the double arrow 51. This direction 51 is a direction orthogonal to the lengthwise direction of the light source 43. By moving the light-irradiating means 49 it is possible to irradiate the light over roughly the entire surface of the substrate 11*b*. Optimization of the inputted power, moving speed, etc. will allow uniform annealing treatment. Instead of moving the light-irradiating means 49, the stage 42 on which the substrate 11*b* is mounted may be moved in the direction 51 to achieve the same effect.

Figure 17:
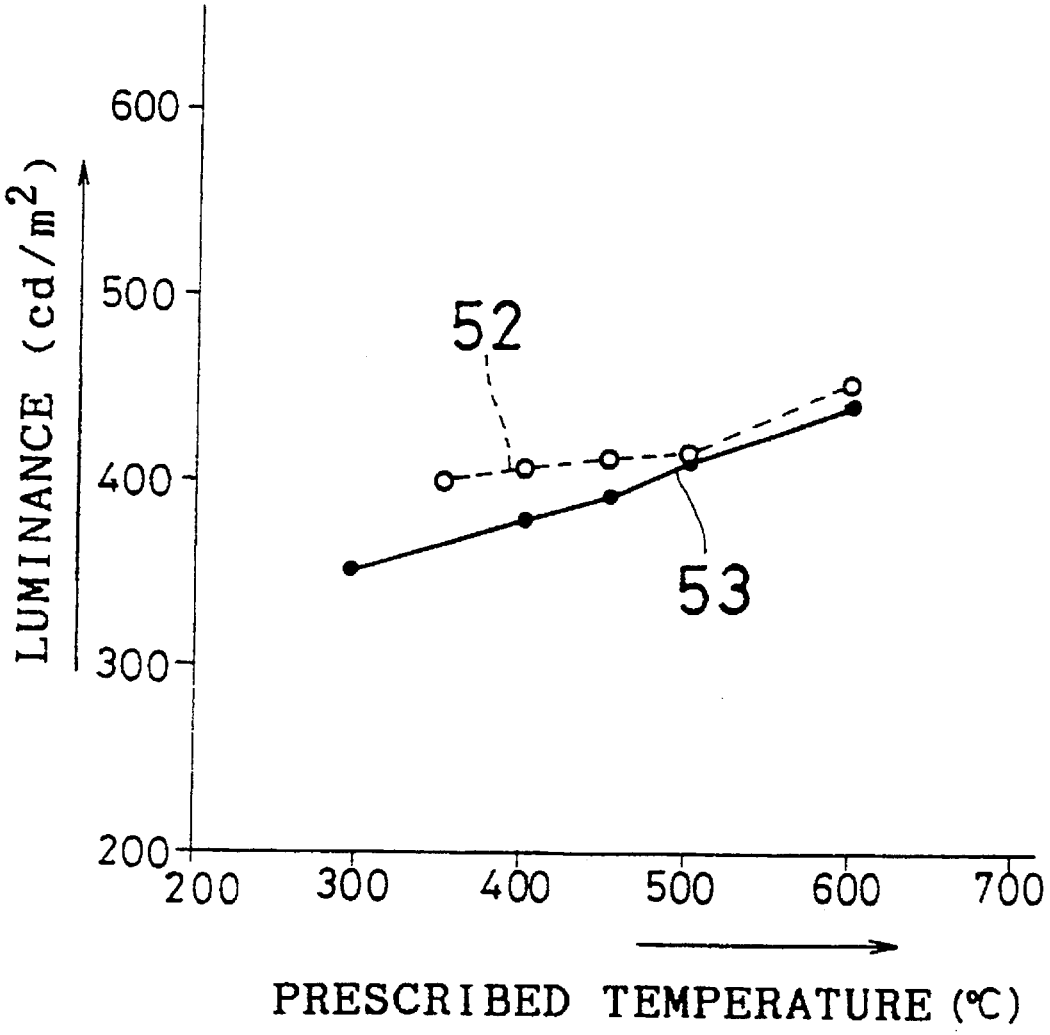
FIG. 17 is a graph showing the relationship between the setting temperature and the luminance, at the time movement is initiated when the temperature measured by the thermocouple 48 reaches the setting temperature, with a moving speed of the light-irradiating means 49 of 2 mm/sec.

FIG. 17 is a graph showing the relationship between the prescribed temperature and the luminance, at the time movement is initiated when the temperature measured by the thermocouple 48 reaches the prescribed temperature, with a moving speed of the light-irradiating means 49 of 2 mm/sec. The broken line 52 represents the results obtained by annealing treatment according to the embodiment, and the solid line 53 represents the results of the aforementioned conventional annealing treatment.

It is understood from FIG. 17 that the luminances according to the present embodiment were higher than those of the prior art. It is also understood that a lower prescribed temperature resulted in a higher degree of increase in luminance, and when the prescribed temperature is higher the luminance is about the same as with the prior art. This is believed to be because, there being only one light source 43, the EL layer 15 could not be sufficiently heated when the prescribed temperature was higher, and furthermore since there was greater heat release from the EL layer 15, the temperature of the EL layer 15 did not rise as high as in the case of the previous embodiment. Still, the embodiment efficiently provided thin-film EL devices with luminances of the same level as with the prior art.

Incidentally, because the light is condensed, it is possible to more rapidly raise the temperature of the light-irradiated sections and thus reach a higher temperature, than in the case of the previous embodiment. Furthermore, fewer infrared lamps are used, which reduces both power consumption and the size of the apparatus.

Figure 18:
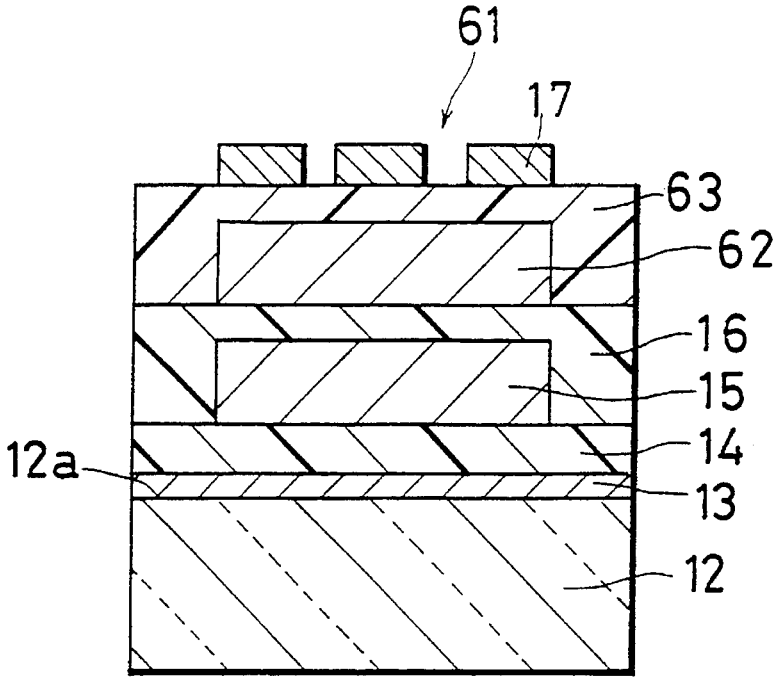
FIG. 18 is a cross-sectional view of the construction of another thin-film EL device 61.
Figure 19:
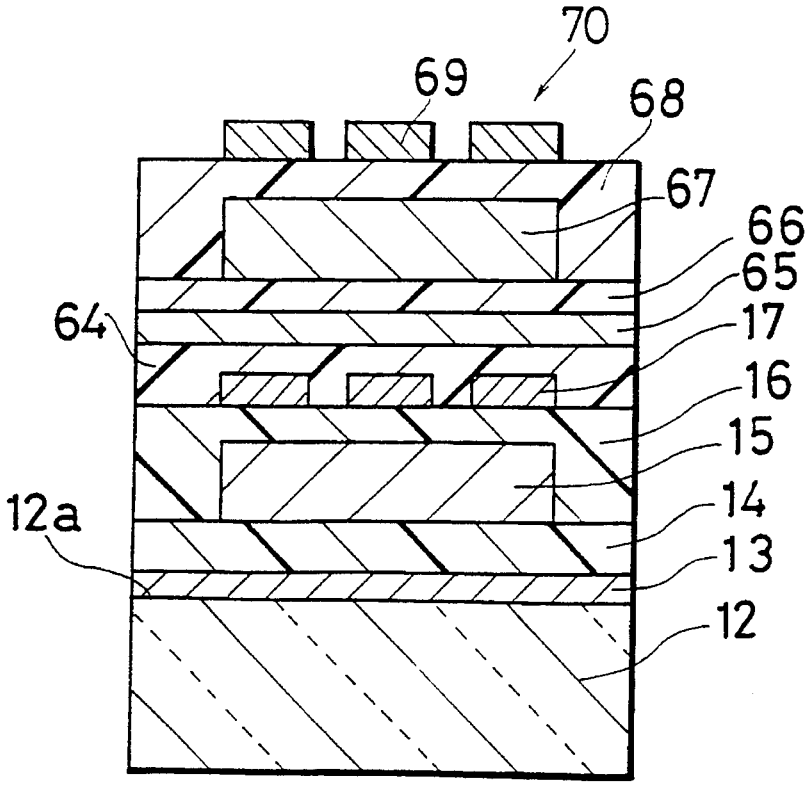
FIG. 19 is a cross-sectional view of the construction of yet another thin-film EL device 70.
Figure 20:
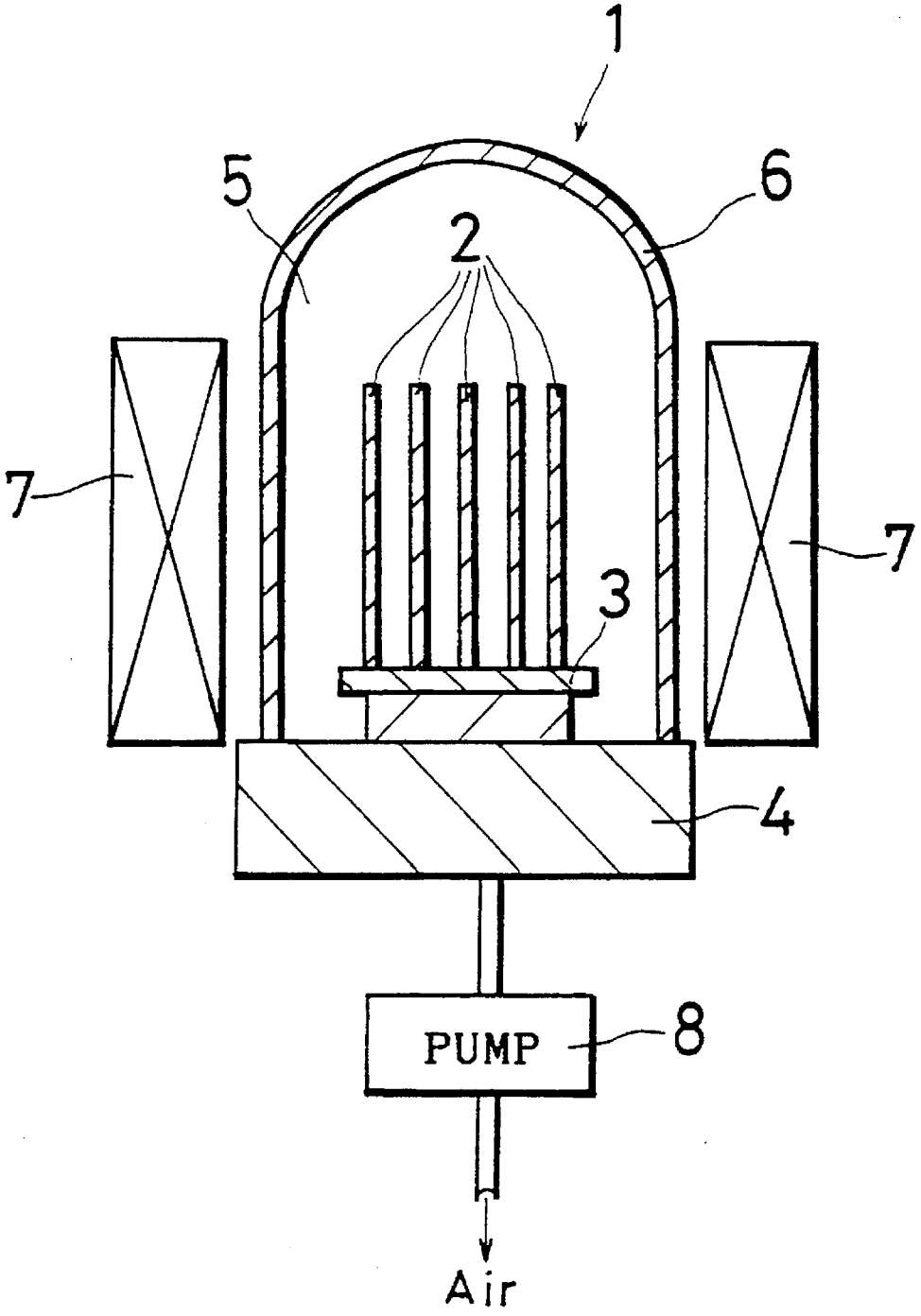
FIG. 20 PRIOR ART
FIG. 20 is a schematic cross-sectional view of an annealing apparatus 1 used for the production of a conventional thin-film EL device.
Figure 21:
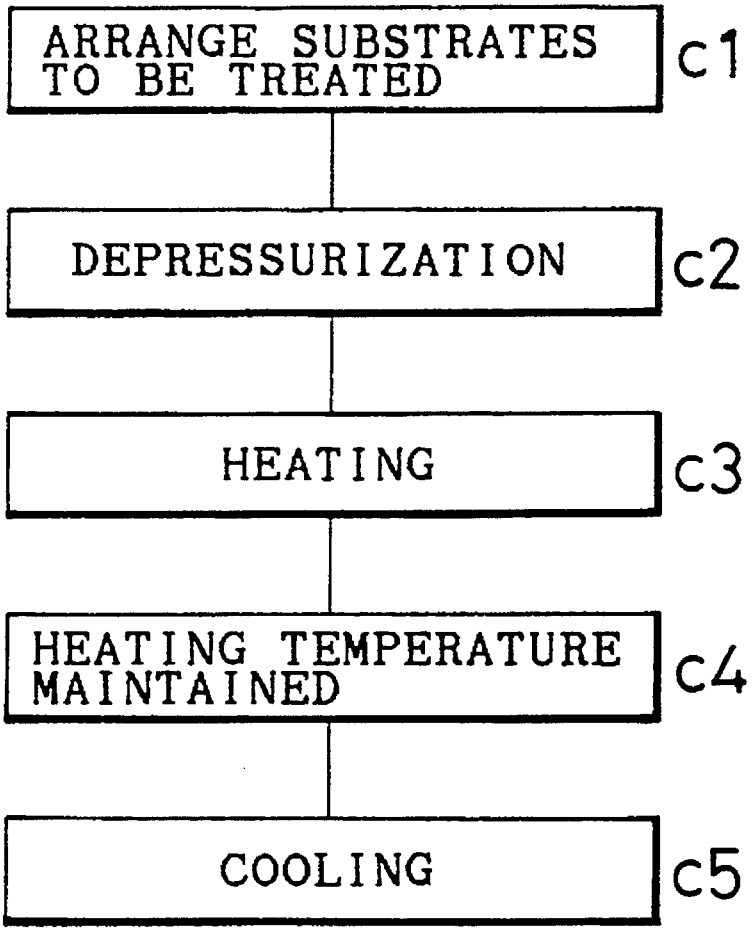
FIG. 21 PRIOR ART
FIG. 21 is a flow diagram showing the steps of conventional annealing treatment using the above-mentioned annealing apparatus 1.

FIGS. 18 and 19 are cross-sectional views of constructions of other thin-film EL devices 61, 70. The same reference numbers are used for the members corresponding to those of the thin-film EL device 11 described earlier. The thin-film EL device 61 is prepared, in the same manner as the thin-film EL device 11 described earlier, by forming lower electrodes 13, a lower insulating layer 14, an EL layer 15 and an upper insulating layer 16 in that order on one surface 12*a* of a translucent substrate 12, additionally forming thereon an EL layer 62 with the same construction as the previous thin-film EL layer 15 and an insulating layer 63 in that order, and then further forming upper electrodes 17 on the insulating layer 63.

Also, the thin-film EL device 70 is prepared by forming lower electrodes 13, a lower insulating layer 14, an EL layer 15, an upper insulating layer 16 and upper electrodes 17 on one surface 12*a* of a translucent substrate 12, forming thereon an additional insulating layer 64, and then further forming thereon a lower electrode 65, a lower insulating layer 66, an EL layer 67, an upper insulating layer 68 and upper electrodes 69, having the same construction as described above. Annealing treatment may be performed in the manner described earlier even on the thin-film EL devices 61, 70 with the multiple EL layers 15, 62, 67. In this case, the annealing treatment is performed after formation of the final EL layer (EL layer 62 for the thin-film EL device 61, and EL layer 67 for the thin-film EL device 70).

The present embodiment has been explained for cases in which ITO is used as the material for the lower electrode 13 of the thin-film EL device 11 and the annealing treatment is performed by irradiation with infrared light; however, electrode materials other than ITO, such as $SnO_2$, $Cd_2SnO_4$, CdO and the like, or mixtures of ZnO and Al and the like may be used to prepare the lower electrodes 13, in which case the annealing treatment is performed by irradiation with light containing rays in the absorption wavelength band of the particular electrode material used. The absorption wavelength band of the electrode material used may be determined in the same manner as for the ITO used in the embodiment.

The upper electrodes 17 may be made of materials other than Al, such as Ta, Mo, W and the like, and further, they may be made of the same material as the lower electrodes 13.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing a thin-film EL device, which comprises the steps of:

providing said thin-film EL device comprising at least one EL layer and electrodes for applying an electric field to the EL layer and heating the EL layer which comprises a host material and luminescence centers incorporated therein, by irradiation of light which includes rays in the absorption wavelength band of electrode material used to construct the electrodes, wherein an annealing treatment is conducted to improve the crystallinity of the host material as well as to render uniform, the distribution of the luminescence centers in the host material.

2. The method of claim 1, wherein indium tin oxide is selected as the electrode material, and light with a peak wavelength in the wavelength band of from 1.1 to 1.5 μm is selected as the light.

3. The method of claim 1, wherein the temperature-elevating rate at the time of the annealing treatment is selected within a range of 200° to 600° C. per minute.

4. The method of claim 3, wherein the temperature-elevating rate is selected within a range of 400° to 500° C. per minute.

5. The method of claim 1, wherein the light irradiation is terminated immediately after the EL layer reaches a prescribed temperature.

6. The method of claim 1, wherein the light is irradiated in an inert gas atmosphere.

7. The method of claim 6, wherein the inert gas in said inert gas atmosphere is selected from the group consisting of $N_2$, Ar, He and combinations thereof.

* * * * *